US005560497A

United States Patent [19]

Mulvihill, Jr.

[11] Patent Number: 5,560,497

[45] Date of Patent: Oct. 1, 1996

[54] ARTICLE HOLDER

[76] Inventor: James P. Mulvihill, Jr., 819 Pierson Run Rd., Pittsburgh, Pa. 15239

[21] Appl. No.: 268,250

[22] Filed: Jun. 29, 1994

[51] Int. Cl.[6] ..... A47F 5/00

[52] U.S. Cl. ..... 211/4; 211/87; 211/64; 248/551; 248/309.1

[58] Field of Search ..... 211/86, 87, 88, 211/4, 70.5, 65, 66, 70.6, 64; 248/316.5, 309.1, 551, 553, 222.4, 223.1

[56] References Cited

U.S. PATENT DOCUMENTS

| | | | |
|---|---|---|---|
| D. 217,225 | 4/1970 | Fitzsimmons . | |
| D. 242,966 | 1/1977 | MacMillan . | |
| D. 281,576 | 12/1985 | Akers . | |
| D. 283,032 | 3/1986 | Quesnel . | |
| D. 308,782 | 6/1990 | Getsi . | |
| D. 316,000 | 4/1991 | Logan . | |
| D. 329,349 | 9/1992 | Moreno . | |
| 347,685 | 8/1886 | Card | 248/551 X |
| 1,120,542 | 12/1914 | Rogers . | |
| 1,208,633 | 12/1916 | Paris . | |
| 1,547,178 | 7/1925 | Long . | |
| 1,611,550 | 12/1926 | Moss . | |
| 1,700,934 | 2/1929 | Halma . | |
| 1,714,048 | 5/1929 | Reeder . | |
| 1,774,840 | 9/1930 | Otto . | |
| 1,997,895 | 4/1935 | Youmans . | |
| 2,575,971 | 11/1951 | Navarro . | |
| 2,609,987 | 9/1952 | Navarro . | |
| 2,616,647 | 11/1952 | Murchison . | |
| 2,623,639 | 12/1952 | Levy | 211/4 |
| 2,946,452 | 7/1960 | Caloiero et al. | 211/4 |
| 2,958,423 | 11/1960 | Caloiero . | |
| 3,270,995 | 9/1966 | Shears . | |
| 3,291,317 | 12/1966 | Bowen | 211/4 |
| 3,326,385 | 6/1967 | Pinkerton et al. | 211/4 |
| 3,330,573 | 7/1967 | Sieloff | 211/70.5 X |
| 3,643,811 | 2/1972 | Howerton | 211/4 X |
| 3,921,812 | 11/1975 | Hamrock et al. | 211/70.6 |
| 4,037,815 | 7/1977 | DeLano . | |
| 4,056,190 | 11/1977 | Dix | 211/70.6 |
| 4,062,453 | 12/1977 | Gorlach | 211/70.5 |
| 4,078,753 | 3/1978 | Cole . | |
| 4,176,580 | 12/1979 | Gallegos . | |
| 4,624,372 | 11/1986 | Brolin | 211/64 X |
| 4,633,789 | 1/1987 | Kortering et al. | 248/223.1 X |
| 4,696,405 | 9/1987 | Waring | 211/64 X |
| 4,696,461 | 9/1987 | Zelinski | 211/64 X |
| 5,339,966 | 8/1994 | Bastiaans | 211/64 X |
| 5,344,030 | 9/1994 | Evenson | 211/88 X |

OTHER PUBLICATIONS

Murchison Applicant submits only the sheet containing Figs. 1–8.

Des. 281,576 Applicant submits only the sheet containing Figs. 1–5.

*Primary Examiner*—Robert W. Gibson, Jr.

*Attorney, Agent, or Firm*—Daniel A. Sullivan, Jr.

[57] ABSTRACT

An article holder of the invention has a forked shoe and a drawer, the shoe and drawer being coordinated with one another on a wall base, such that the shoe serves as a lid for the drawer, when the drawer is in its in-position. The fork of the shoe extends beyond the drawer in the in-position, so that an article supported in the fork may block movement of the drawer out of the in-position. A special locking structure is provided to close the fork and transmit force to stress the fork legs uniformly in tension. The wall base is equipped with a special mounting system comprised of a pocket, which grasps a fastener head of a first fastener shank in a slot adjoining its opening, and a hole through a second fastener may be driven, once the head of the first fastener is grasped. The wall base may have a silhouette suggesting a type of article which may be supported in the holder. A bottom base may be included as part of the holder, to carry the weight of an article supported in the holder, in which case, the fork simply provides lateral support for the article.

18 Claims, 14 Drawing Sheets

ARTICLE HOLDER

LIMITED COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED DOCUMENT

Disclosure Document No. 345,634, filed in the U.S. Patent and Trademark Office on Jan. 7, 1994, describes the invention and is incorporated herein by reference.

TECHNICAL FIELD

This invention relates to a holder for articles. Examples of articles which may be held by the invented holder are guitars and other stringed musical instruments. The holder is suitable for other articles, as well. For instance, guns, such as shotguns, may be held in the holder of the invention.

Terminology used herein to refer to the parts of a guitar and the parts of a shotgun is as presented in the book "What's What—A Visual Glossary of the Physical World" by Bragonier and Fisher, Ballantine Books, New York, 1981, pages 356 and 458.

DISCLOSURE OF INVENTION

It is an object of the invention to provide a novel holder to support an article and provide accessory storage capability.

Another object of the invention is to provide an article holder featuring a novel gate offering added security in retaining an article in position in the holder.

According to a third object of the invention, there is provided a novel mounting system useful for attaching an object, such as a holder of the invention, to a surface.

These objects, as well as other objects which will become apparent from the detailed description of examples given below, are accomplished according to the invention by a holder comprising a forked shoe. In examples of the invention, a drawer is combined with the shoe to provide an accessory storage capability; and/or the shoe is closed by a gate fitting in corresponding recesses on the forked portion. A special mounting system of the invention is characterized by an initial grasping of a fastener head in a specially formed pocket on, for instance, a holder of the invention, followed by the driving of a second fastener through a hole on the holder, to provide added attachment and to retain the grasping of the first fastener head in the pocket.

BRIEF DESCRIPTION OF THE DRAWINGS

FIGS. 10B to 10D, illustrate steps in using a mounting system of the invention.

MODES OF CARRYING OUT THE INVENTION

Figure 1:
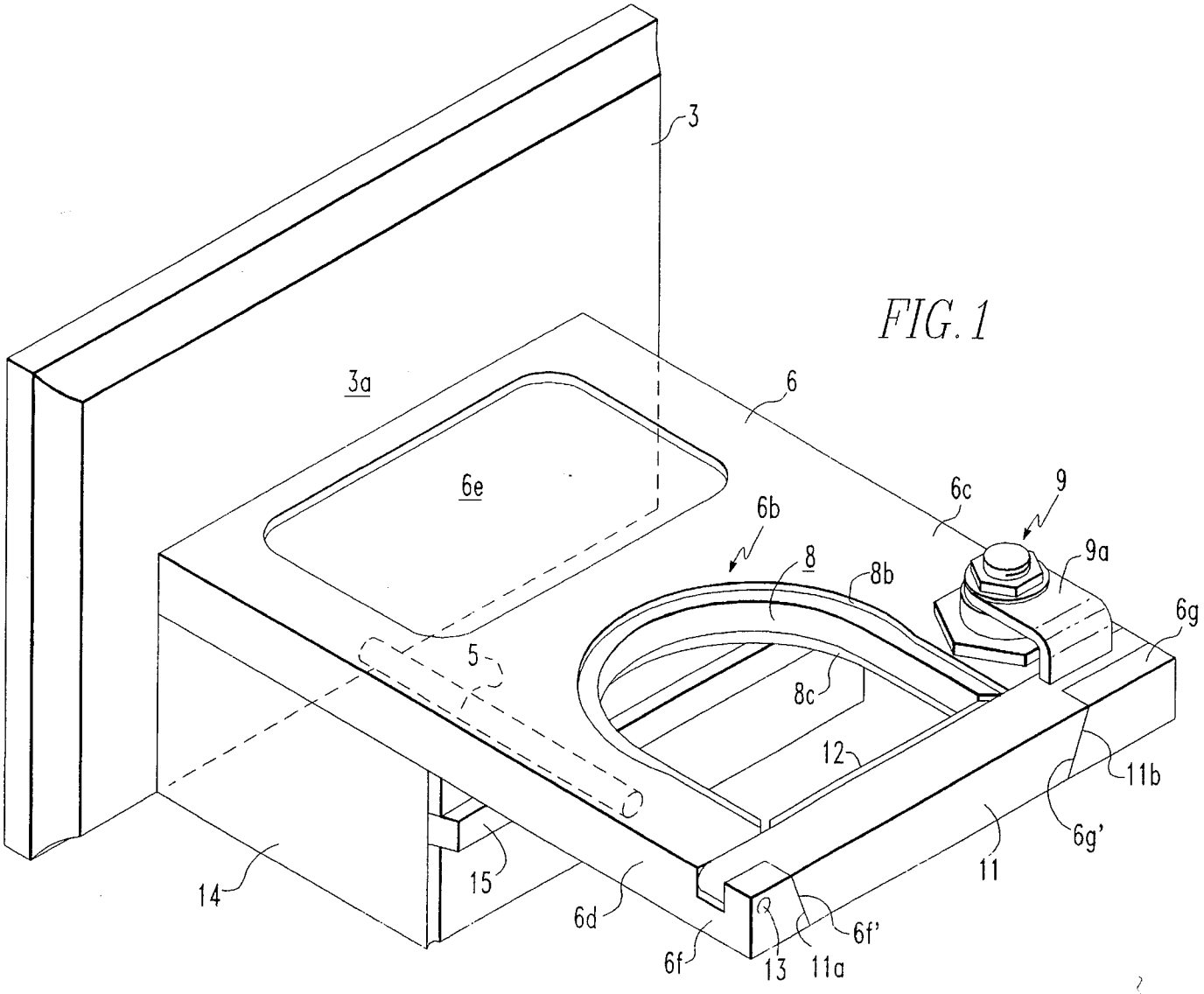
FIG. 1 is an isometric view of a holder of the invention.
Figure 5:
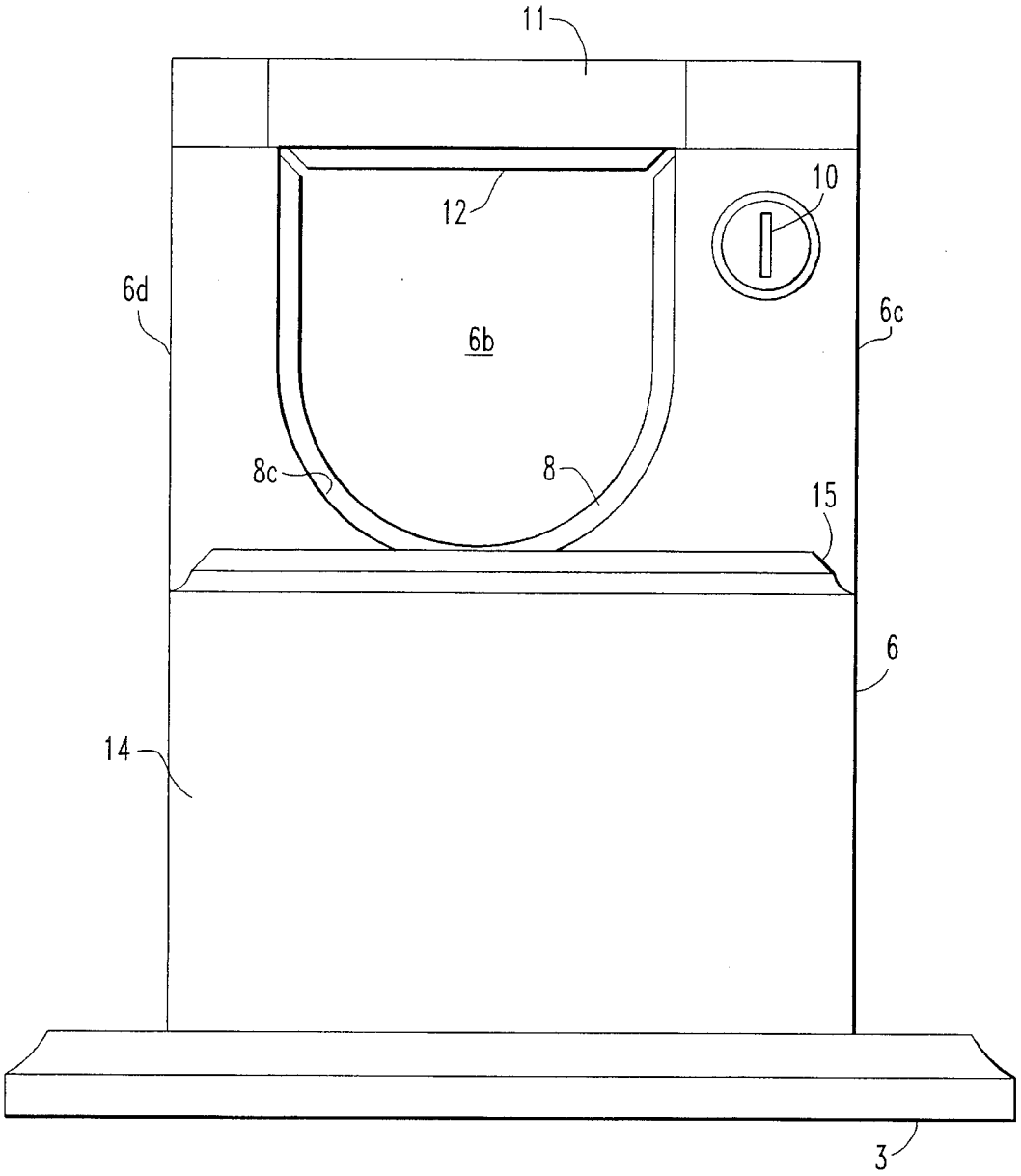
FIG. 5 is a bottom view of the holder of FIG. 1.
Figure 6:
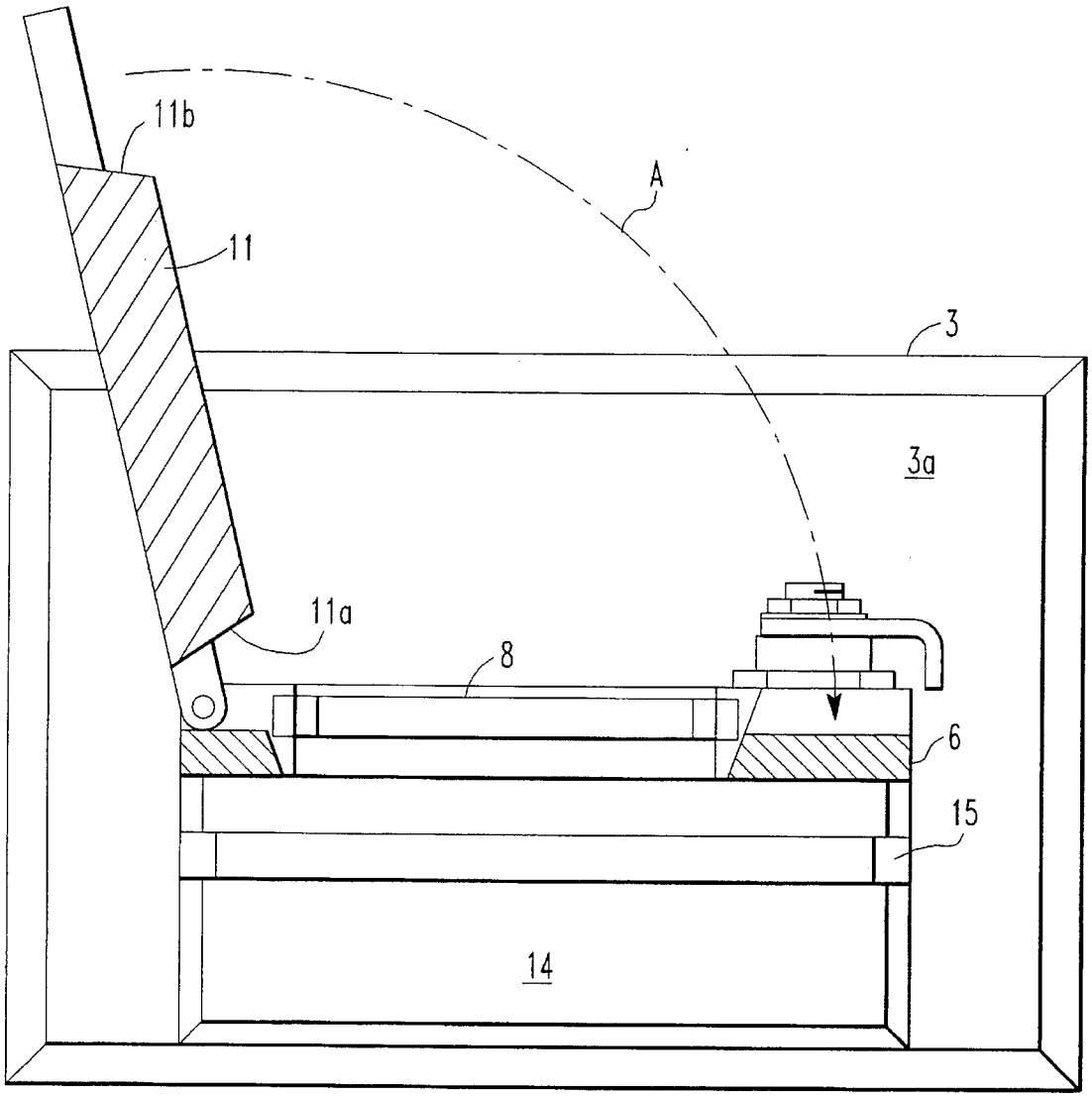
FIG. 6 is a cross sectional view taken on cutting plane VI—VI of FIG. 4, with a gate of the holder shown in raised position and the lock latch in the open position, and the path of travel of the gate into closed position shown by a dashed arrow.
Figure 7:
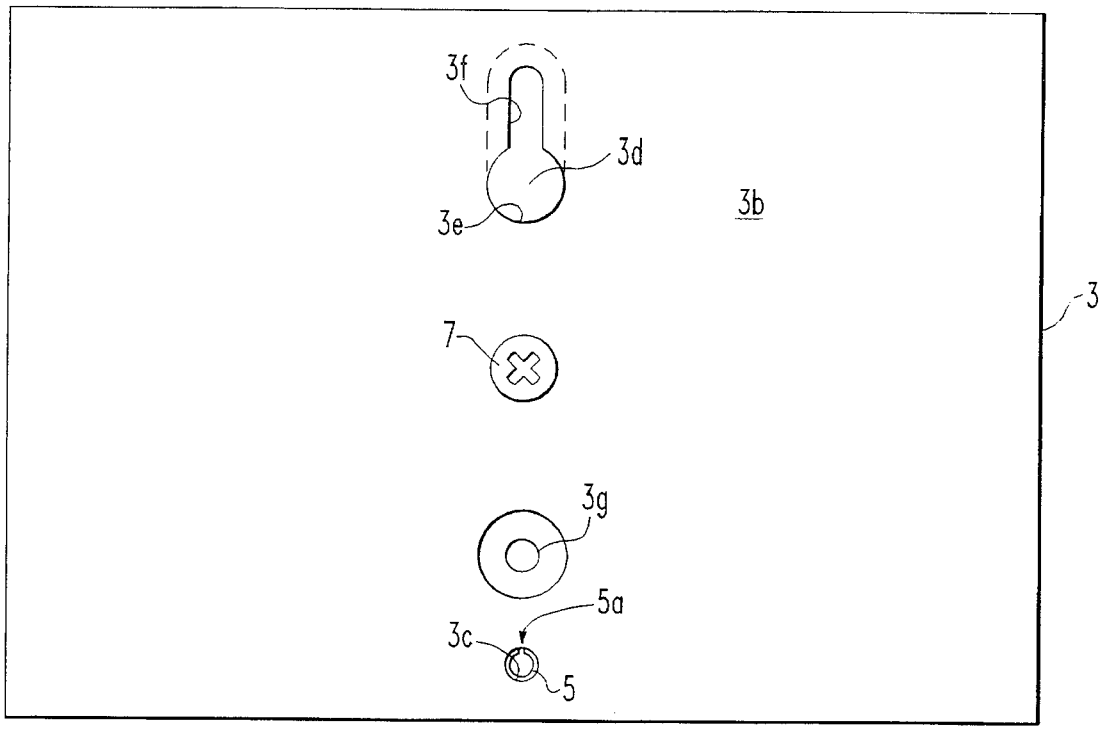
FIG. 7 is an elevational, back view onto the wall side of the holder of FIG. 1.

FIGS. 1–10D illustrate one advantageous embodiment of an article holder of the invention. With reference particularly to FIG. 1, a wall base 3 is provided for mounting purposes, for instance against a den wall in a guitar owner's house. The wall base also serves to coordinate other structural components of the holder to one another, as will become apparent from what follows below. The wall base has a front side 3*a* (FIGS. 1 and 8) and a wall side 3*b* (FIG. 7).

The wall base carries a dowel 5, which is mounted perpendicularly on the wall base by a press fit or gluing in a corresponding hole 3*c* (FIG. 7) in a lower middle portion of the wall base. In the illustrated embodiment of dowel 5, it is provided in the form of a tube having a slot 5*a* along its upper length, to facilitate a press fit; see FIGS. 7, 9 and 10.

Figure 1A:
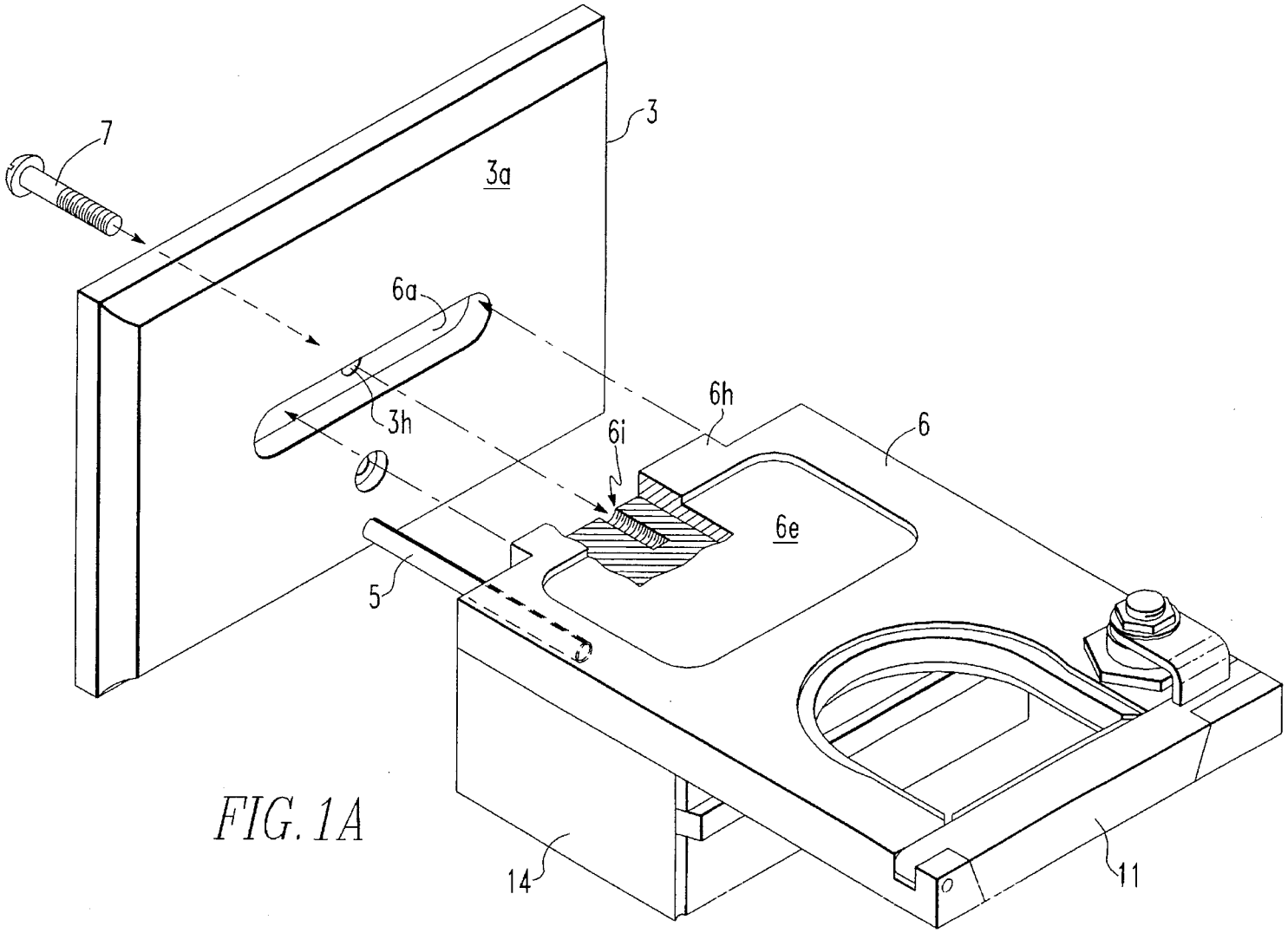
FIG. 1A is an exploded view based on FIG. 1, with a shoe portion of the holder partially cross sectioned at mid-height to expose a threaded hole.
Figure 2:
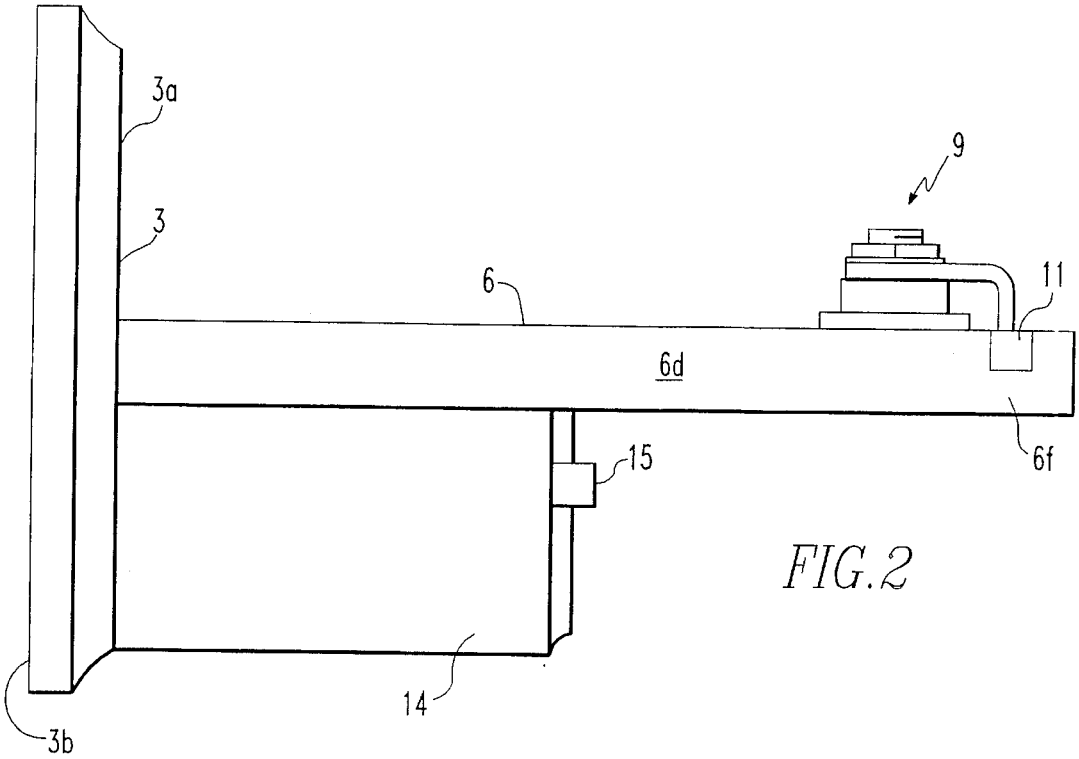
FIGS. 2 and 3 are elevational views from the left and right sides, respectively, of the holder of FIG. 1.
Figure 3:
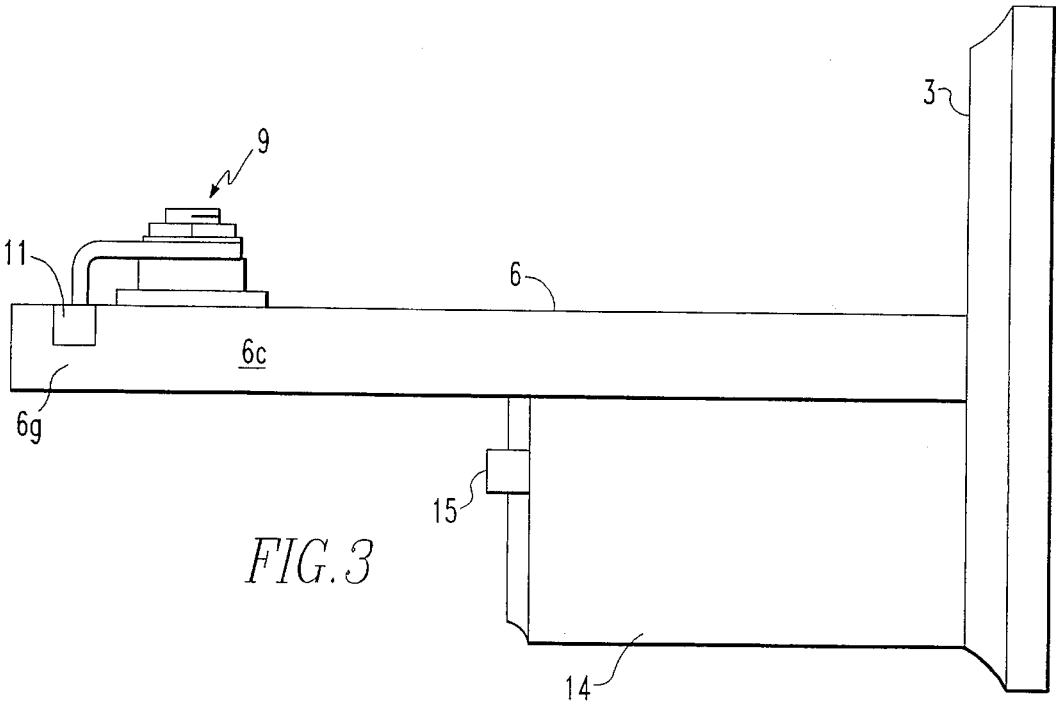
Figure 10:
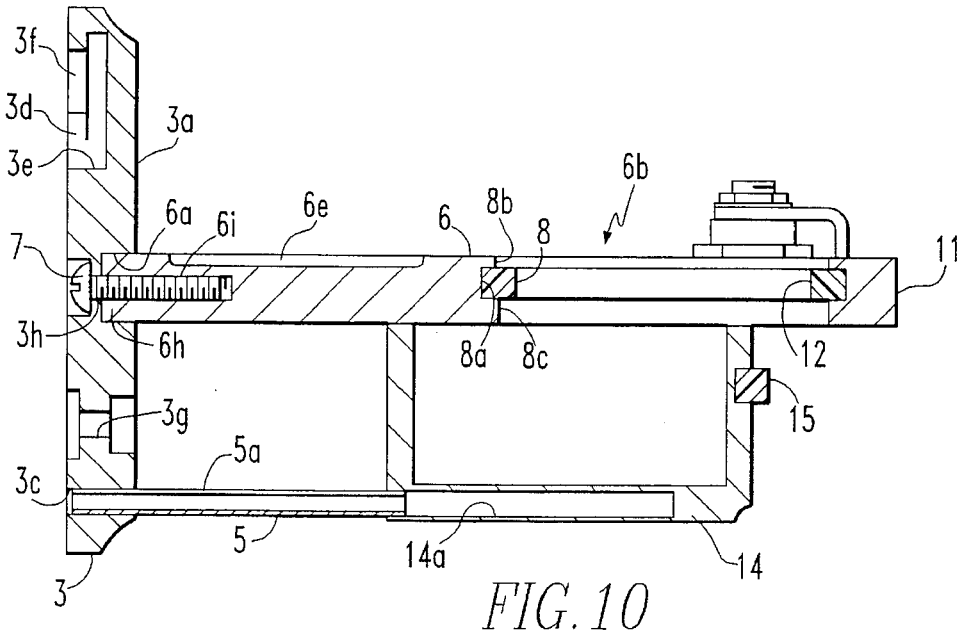
FIG. 10 is a cross sectional view taken per the cutting plane X—X of FIG. 9, with the superstructure shown in solid representation.

Also mounted to the wall base 3, about in the center thereof, is a shoe 6. FIGS. 1A, 7 and 10 show that, by hollowing-out a seat 6*a* for the shoe, to about one-half depth into the wall base from the front side 3*a*, a one-screw 7 attachment of the shoe to the wall base is obtained. Such means of attachment prevents twisting of the shoe relative to the wall base about an axis perpendicular to the wall base, despite the fact that only one screw 7 is used. One screw 7 works especially well where the material of the holder is aluminum; two screws, spaced left and right, are preferred in the case of plastic or wood.

The exploded view of FIG. 1A illustrates that seat 6*a* has been milled or routed wider than the corresponding projection 6*h* on shoe 6, for facilitating the manufacturing operation in making seat 6*a*. On the other hand, the upper and lower surfaces of seat 6*a* and projection 6*h* have a touch, or sliding, fit in assembly (FIG. 10), to provide the anti-twist effect. Centering of projection 6*h* in seat 6*a* is obtained by the interaction of screw 7 with its hole 3*h* through the wall base 3 and its threaded hole **6*i* in shoe 6. As shown in FIG. 10, hole 3*h* is countersunk, in order that the head of screw 7 not interfere with obtaining a flush mounting of wall base 3** against a wall.

Shoe 6 extends perpendicularly from the wall base and terminates in a fork **6*b* with two fork legs 6*c* and 6*d*,** which themselves extend perpendicularly from the wall base.

Shoe 6 has a dish **6*e* on its upper surface, between the wall base and the fork of the shoe. Dish 6*e*** provides an area for the temporary resting of items, such as a guitar plectrum, or pick.

A resilient rubber bumper 8 lines the fork of the shoe. As shown in FIG. 10, bumper 8 is held in a seat **8*a* in the form of a groove which extends around the inside of fork 6*b*. The top edge 8*b* of the seat has been cut back, towards the wall base 3, more than the bottom edge 8*c*, to provide additional relief, such that a flaring section of an article supported in the holder should not contact the top edge 8*b* but only the bumper 8. The fact that edge 8*c* has not been cut back as much as edge 8*b* means that bumper 8 is comparatively well supported underneath, for cases where bumper 8 is to transmit the entire weight of a supported article to shoe 6**.

Figure 4:
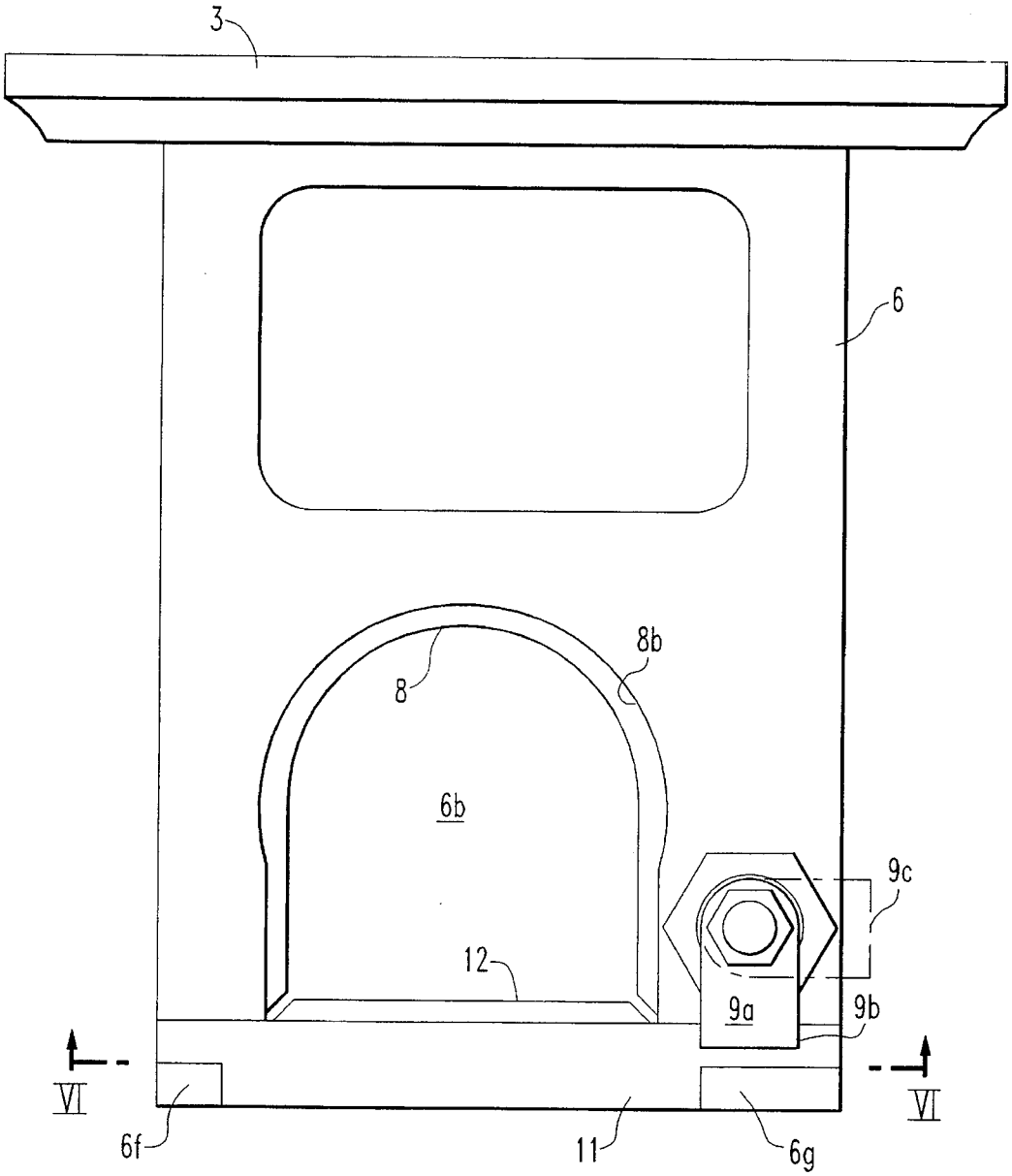
FIG. 4 is a plan view from above the holder as depicted in FIG. 1, with an open position of a lock latch shown in dashed representation.

As will be apparent from a comparison of FIG. 4 with FIG. 5, the greater cutback of edge **8*b* is accomplished by giving the arc of the edge a greater radius, for instance 1 3/16 inches, as compared to the radius used for edge 8*c*, for instance 1 1/8 inches. This results in an arc of greater than 180-degrees for edge 8*b*, as compared to the 180-degree, tangent arc for edge 8*c*.**

As shown from various angles in FIGS. 1 to 4 and 6, the ends of the fork legs **6*c*, 6*d* are recessed in that they are shaped as upturned hooks 6*f* and 6*g*. Gate 11 is rotatably pinned by pin 13 in hook 6*f* and, so, can be swung into, and out of, the position shown in FIGS. 1–5 and 8–10, where the gate closes the fork 6*b*. FIG. 6 shows gate 11 in an open, 11 o'clock position, and the direction of its pivot back into the position closing the fork is indicated by dashed Arrow A. Gate 11** may, as well, be opened fully to the 9 o'clock position.

Gate 11 is chamfered at locations **11*a* and 11*b*, and hooks 6*f* and 6*g* are correspondingly chamfered at locations 6*f'* and 6*g'*, so that the gate is able to make a tight closure with the hooks, to give the appearance of an essentially continuous beam across the fork when the gate is in position closing the fork. The chamfer angle B (FIG. 8**) is, for example, 20-degrees.

Gate 11 carries a resilient rubber bumper 12 on its side facing into the fork.

Cam lock 9 is operable through key slot 10 (FIG. 5) to rotate latch **9*a* between between a gate locking position 9*b* and a gate release position 9*c*; see particularly FIG. 4**.

It will be noted that, when the gate is seated in the recesses of the hook, a strong, positive locking of an article in the holder is achieved. Pulling on the center of the gate perpendicularly from the wall base loads the fork legs uniformly in tension, rather than to load the pivot point with a twisting moment.

With reference to FIGS. 1 to 3, 5, 6, and 8 to 10, drawer 14 is movably mounted below, and relative to, shoe 6, for movement into and out of its in-position in which it is shown in FIGS. 1–3, and 5. When the drawer is in the in-position, shoe 6 serves as a lid for the drawer and the drawer lies below the portion of the shoe which has dish **6*e*. In the in-position of the drawer, fork 6*b*** extends beyond, and, in fact, is clear of, the drawer.

Movement of the drawer relative to the shoe is achieved by a slidable mounting of the drawer on dowel 5; this is accomplished by a corresponding hole **14*a* (FIG. 10) in the floor of the drawer. Shoe 6**, the lid of the drawer, prevents the drawer from rotating on the dowel.

The drawer bears a resilient rubber bumper 15 on its front face.

Figure 8:
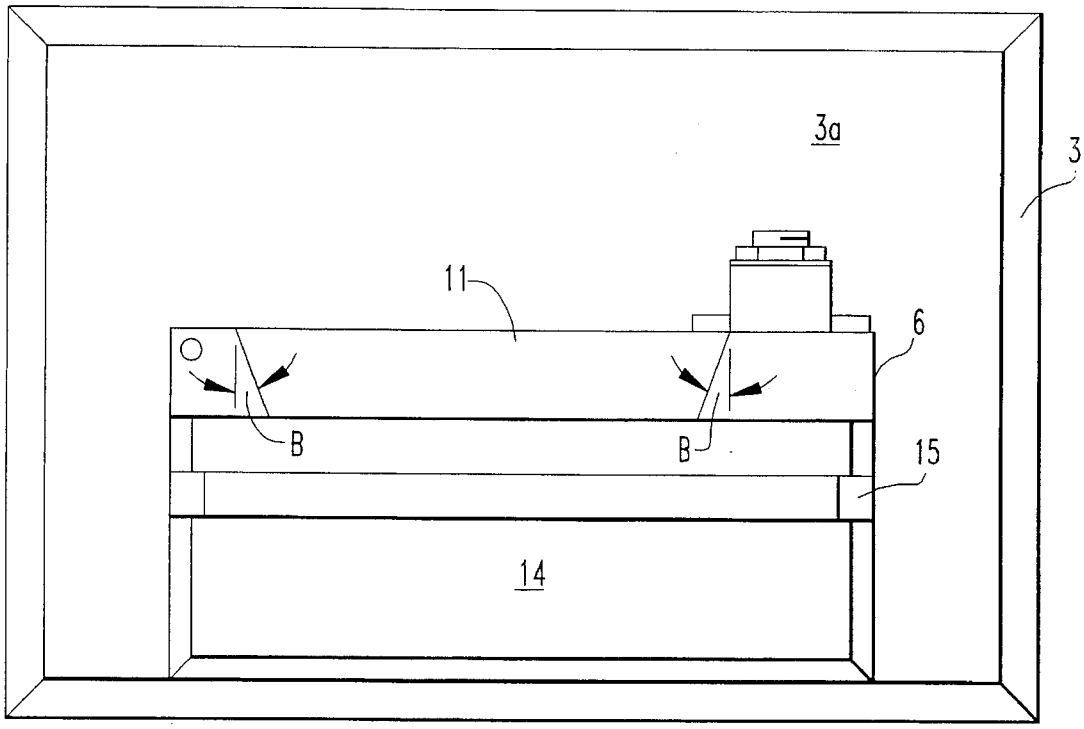
FIG. 8 is a front view of the holder of FIG. 1.

Drawer 14 has a lateral dimension, left and right in FIGS. 6 and 8, such that it can be grasped laterally by one's hand, in order to move it into, and out of, its in-position. An example of a suitable such dimension is 4.0 inches. A design for use by children would be made appropriately smaller.

Figure 9:
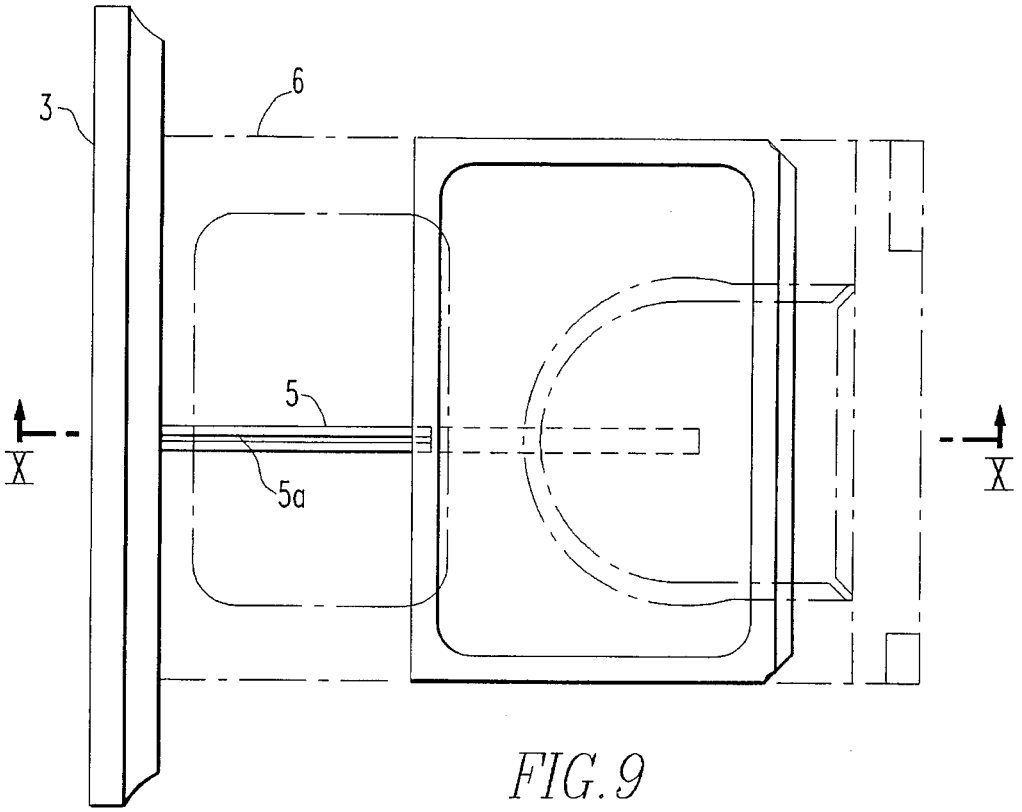
FIG. 9 is a view as in FIG. 4, with a top, shoe portion, or superstructure, shown in dashed representation, to expose the understructure.

FIGS. 9 and 10 illustrate how the drawer may be slid-out on the dowel to where its interior becomes accessible through the fork. The drawer may, of course, be completely removed from the dowel, if desired, and then placed back on the dowel to return it to the in-position.

When the drawer is off the dowel, fastener hole **3*g* (FIG. 10) becomes accessible for driving a fastener, such as a screw, through it for mounting the holder of the invention to a surface. When the drawer is in the in-position, the drawer covers hole 3*g*. Hole 3*g* is countersunk on both sides of wall base 3, on the front side so that it will not prevent drawer 14** from making flush contact with the wall base in the in-position, and on the wall side in order to accomodate any protrusions of wall anchors such as may be used for screw seats in gypsum wallboard.

Hole **3*g* is part of an embodiment of a mounting system of the invention. Hole 3*g* works in conjunction with pocket 3*d* (FIGS. 7 and 10) of the mounting system. Unlike hole 3*g*, the pocket is not visible or accessible from the front side 3*a* of the wall base. On wall side 3*b*, the pocket has an opening 3*e* for receiving a fastener head, for instance the head of a screw or nail that has not been driven completely into the surface. Additionally, the pocket has a slot 3*f*** of smaller lateral size than the opening, extending upwards from the opening, for receiving a shank which bears the head of the fastener.

Figure 10A:
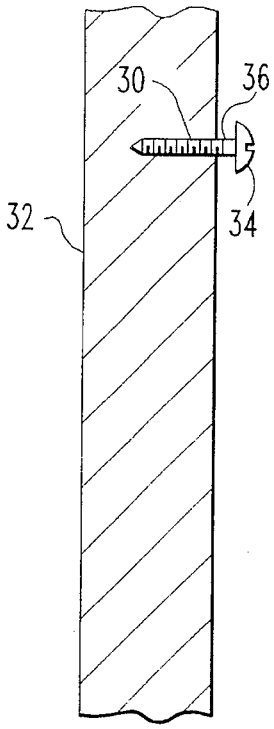
FIGS. 10A to 10D are cross sectional views, using part of FIG. 10.
Figure 10B:
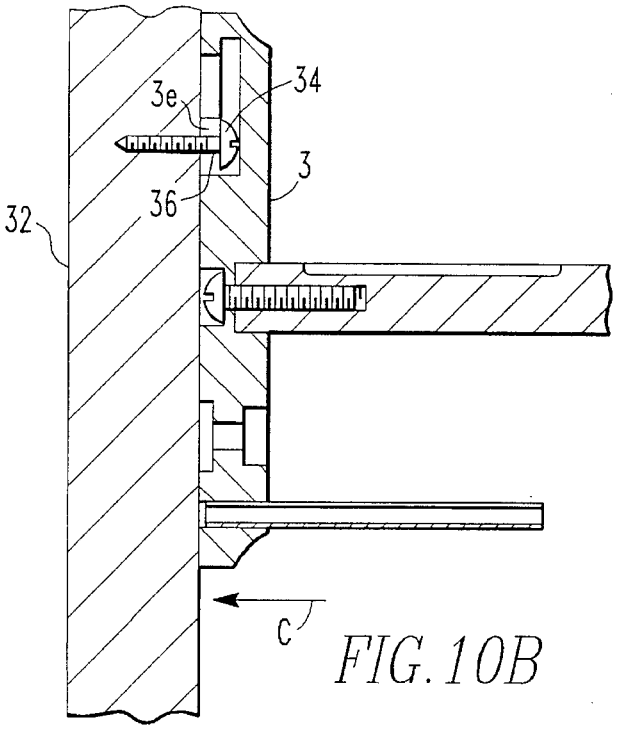
Figure 10C:
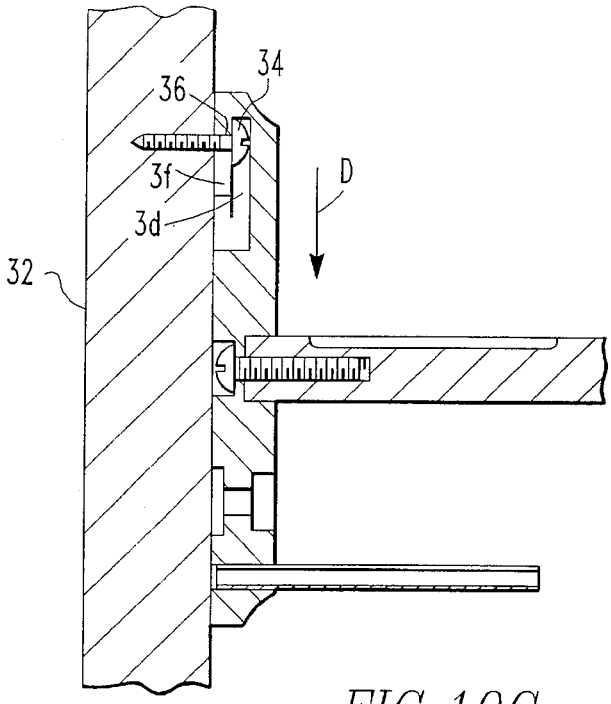
Figure 10D:
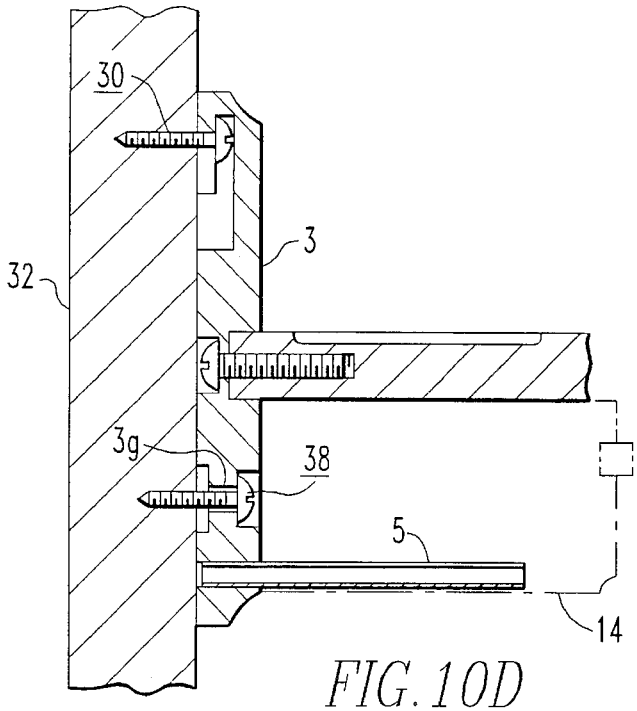

FIGS. 10A to 10D illustrate use of the mounting system of the invention. In FIG. 10A, a first fastener 30 has been driven into wall 32. The head 34 of the fastener remains spaced from the wall, so as to expose the fastener shank 36. In FIG. 10B, wall base 3 has been moved in the direction of arrow C, such that head 34 has passed through opening **3*e*. Then, in FIG. 10C, the wall base has been moved in the direction of arrow D, such that the head 34 is now at the top of pocket 3*d* and shank 36 is in slot 3*f*. Finally, in FIG. 10D, a second fastener 38 has been driven through hole 3*g*, to complete the mounting. Drawer 14 may then be put in place on dowel 5**, as indicated by the dashed representation, to hide the second fastener.

Figure 11:
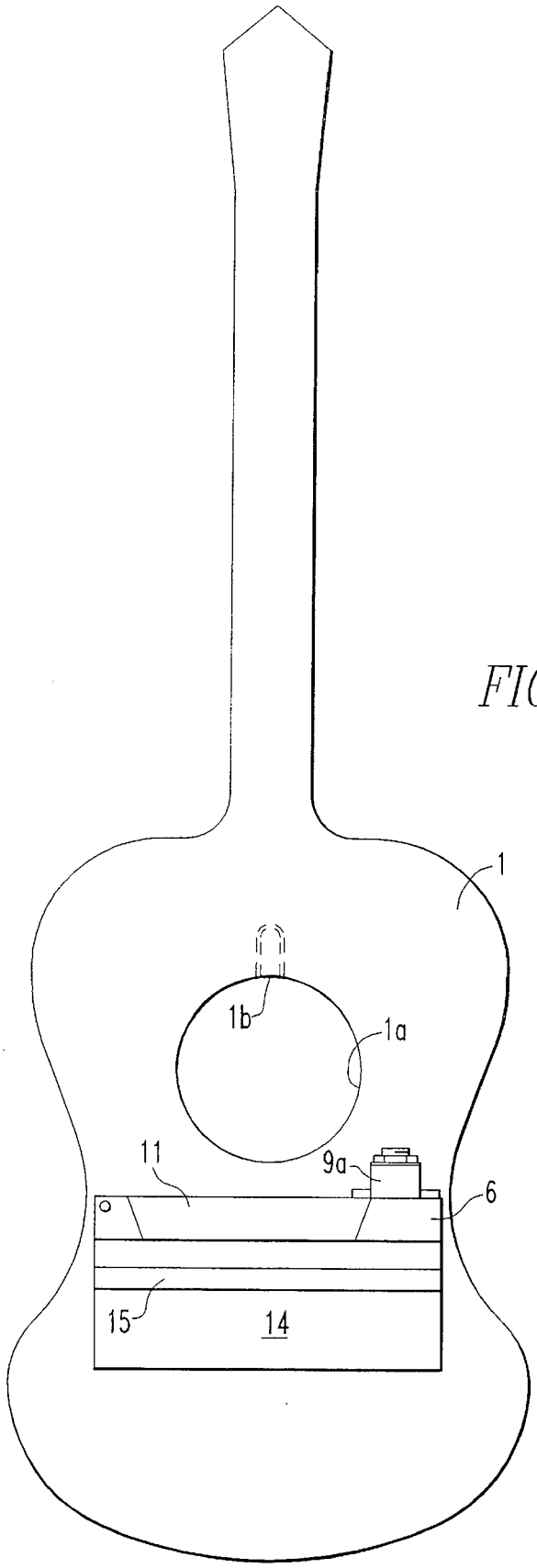
FIG. 11 is a front view of a second embodiment of the invention.

With reference now to FIG. 11, this drawing shows a second embodiment of the invention, which is like the embodiment of FIGS. 1–10D, except that, in place of a wall base shaped like wall base 3, this embodiment has a wall base 1 in the shape of an acoustic guitar silhouette. This embodiment presents a potential user with a suggestion of the character of article that might be supported in the holder—in this case, an acoustic guitar. The silhouette includes a central hole **1*a*** as a replica of the sound hole of an acoustic guitar.

Wall base 1 uses the same type of mounting system used for making wall base 3 mountable to a surface. Conveniently, the pocket may be opened by milling, or routing, upwards from the 12-o'clock location **1*b* on the hole 1*a*. Since the pocket and slot are on the wall side, they are hidden and, consequently, shown by dashed lines in FIG. 11. In this embodiment of the mounting system of the invention, the opening provided by hole 1***a* corresponds to opening 3*e* in the embodiment of FIGS. 1–10D.

Figure 12:
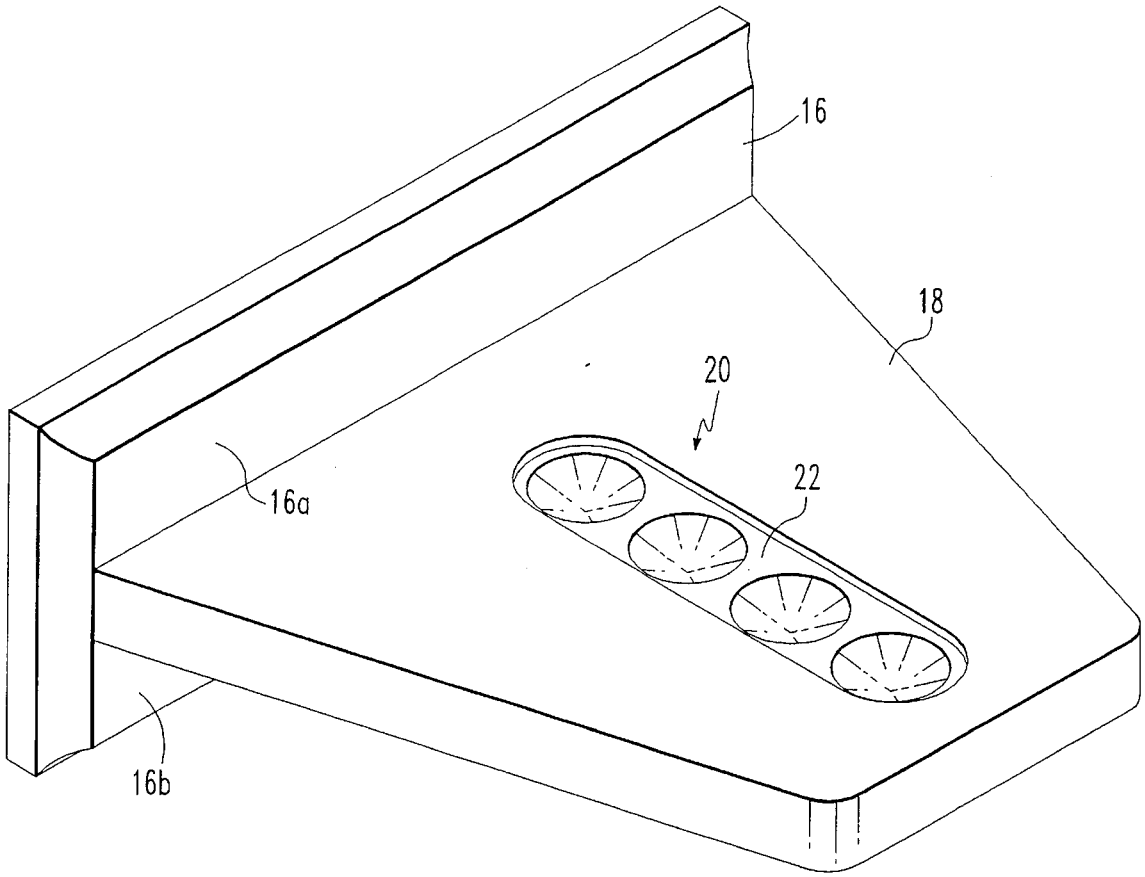
FIG. 12 is isometric view of a bottom base of the invention.

FIG. 12 shows a bottom base of the invention. The bottom base includes a wall base 16 and a shoe 18 mounted perpendicularly at half-height on the wall base 16. The upper surface of shoe 18 has four dimples 20 arranged in line perpendicularly to wall base 16. The dimples lie on the floor of a groove 22 also extending perpendicularly to wall base 16. The dimples may have a generally conical shape, as shown, with cone elements inclined, for example, 15-degrees downwards from the horizontal.

Wall base 16 has the same mounting system as used for wall base 3; the pocket lies centrally behind upper portion 16*a* and the hole is centrally through the bottom portion 16*b*. While the hole does not have a drawer to hide it as in the structure of FIGS. 1–10D, shoe 18 will ordinarily be below eye-level in use, such that the hole and a fastener in it will not be visible, unless one squats, or bends, down sufficiently to look below shoe 18.

Figure 13:
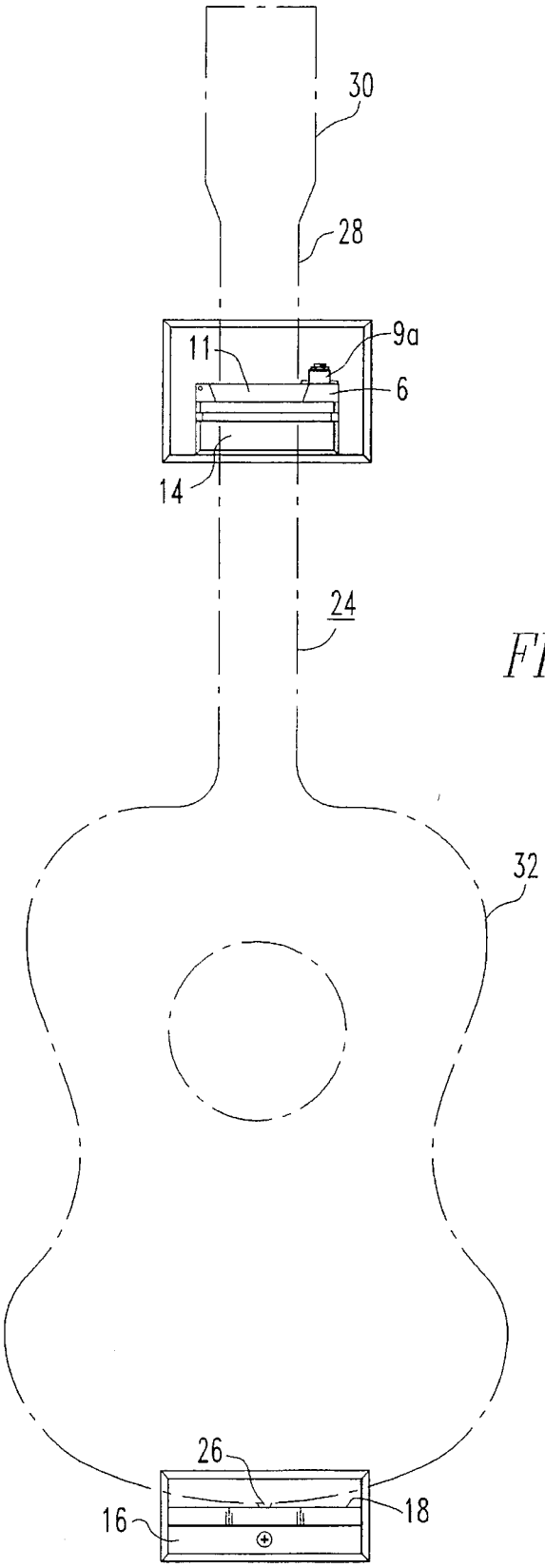
FIG. 13 is a front view of a holder of the invention, modified from that shown in FIG. 1 to include the bottom base of FIG. 12, shown supporting a guitar in dashed representation.

FIG. 13 shows an article holder of the invention, including the structure of FIGS. 1–10D and the structure of FIG. 12, both structures mounted with the wall bases to a wall, with a guitar 24 supported therein. The lower strap-button 26 of the guitar rests in an appropriate one of the dimples on shoe 18, depending on the depth of the particular guitar. Thus, the structure of FIGS. 1–10D has been appropriately spaced above that of FIG. 12, such that the weight of the guitar is supported by the contact between button 26 and the dimple in which it is seated. Guitar neck 28 is simply supported against lateral movement by the bumpers 8 and 12, and possibly 15, of the structure of FIGS. 1–10D. It will be evident that the structure of FIGS. 1 to 10D and the structure of FIG. 12 may be provided in kit form, such that the consumer may create a coordinated mounting of the two structures as shown in FIG. 13 in a home or office.

To place the guitar in FIG. 13, one opens the cam lock, pivots gate 11 open, rests the guitar strap-button in an appropriate dimple, and moves the neck of the guitar into the fork 6*b*. Groove 22 helps to locate a dimple; with a lateral sliding movement on shoe 18, the strap-button falls into groove 22, following which the guitar is moved perpendicularly to wall base 16 until the button falls into a suitable dimple. The gate is then pivoted downwards to close the fork, and the cam lock operated to bring latch 9*a* into place to secure the gate in place. With the guitar locked in place, drawer 14 cannot be opened, and access to a screw in hole 3*g* is blocked.

The structure of FIGS. 1–10D may be used alone, instead of in conjunction with the structure of FIG. 12, in which case the flare between the guitar neck 28 and the head 30 bears the weight of the guitar onto the bumper 8 and shoe 6.

Figure 14:
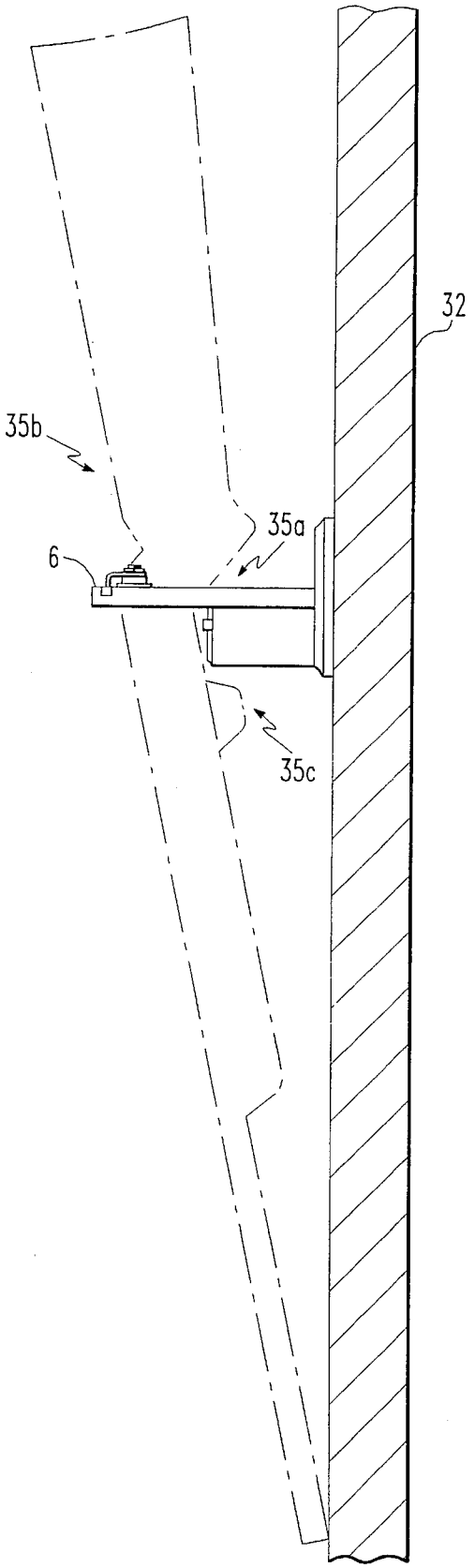
FIG. 14 is a side view of a holder of the invention, shown supporting a shotgun.

FIG. 14 shows a shotgun held in the holder of the invention. This illustrates that it is preferred that the holder of the invention be used to support articles which have a region of narrow cross section (for the shotgun, the so-called "small" 35*a* of the stock) fitting in fork 6*b*, between regions of greater cross section (for the shotgun, the butt 35*b* on one side and the trigger guard/receiver 35*c* on the other), which are larger than the capacity of fork 6*b*. In this way, an article locked in the holder can not be removed upwards or downwards, out of the holder. It will be noted that the guitar in FIG. 13 shows this same character, the head 30 and body 32 preventing removal when neck 28 is in the locked holder.

The holder of the invention may be made of various materials, such as aluminum, plastic, or wood.

The holder of the invention, as illustrated in the accompanying drawings, has an ornamental character in addition to its utilitarian nature. Particularly pleasing to the eye is an embodiment like that of FIGS. 1–10D, in which the wall base, drawer and gate are made of aluminum and the bumpers are of black rubber. The aluminum may be anodized to provide a resistant surface and a variety of colors.

It is to be understood that changes may be made in the modes disclosed here without departing from the spirit or scope of the invention which is defined in the following claims.

I claim:

1. A holder to support an article and provide accessory storage capability, comprising a forked shoe and a drawer movably mounted relative to the shoe into and out of an in-position, whereby an article may be supported in the fork of the shoe and accessories may be stored in the drawer, further comprising a wall base, the shoe and the drawer being mounted on the wall base, the wall base having a fastener hole, the drawer covering the hole in the in-position.

2. A holder as claimed in claim 1, the wall base having a front side and a wall side, and a securing means on the wall side, the securing means being inaccessible from the front side.

3. A holder as claimed in claim 2, the securing means comprising a pocket means for receiving and gripping a fastener head.

4. A holder to support an article and provide accessory storage capability, comprising a forked shoe and a drawer movably mounted relative to the shoe into and out of an in-position, whereby an article may be supported in the fork of the shoe and accessories may be stored in the drawer, the fork extending beyond the drawer when the drawer is in the in-position, the drawer moving below the fork in moving out of the in-position, whereby accessories may be placed into, or removed from, the drawer through the fork.

5. A holder to support an article and provide accessory storage capability, comprising a forked shoe and a drawer movably mounted relative to the shoe into and out of an in-position, whereby an article may be supported in the fork of the shoe and accessories may be stored in the drawer, the drawer being below the shoe, the drawer moving below the fork in moving into and out of the in-position, the fork extending beyond the drawer when the drawer is in the in-position, whereby an article supported in the fork may block movement of the drawer out of the in-position.

6. A holder to support an article and provide accessory storage capability, comprising a forked shoe and a drawer movably mounted relative to the shoe into and out of an in-position, whereby an article maybe supported in the fork of the shoe and accessories may be stored in the drawer, the shoe serving as a lid for the drawer when the drawer is in its in-position.

7. A holder as claimed in claim 6, further comprising a wall base and a dowel, the shoe and the dowel being mounted on the wall base, the drawer being slidably mounted on the dowel.

8. A holder as claimed in claim 7, the drawer being sized so as to be graspable laterally by one's hand for moving the drawer.

9. A holder as claimed in claim 5, further comprising a gate means for closing and opening the fork.

10. A holder as claimed in claim 5, further comprising a wall base, the shoe and the drawer being mounted on the wall base, and a bottom base means for carrying the weight of an article supported in the fork of the shoe.

11. A holder to support an article and provide accessory storage capability, comprising a forked shoe and a drawer movably mounted relative to the shoe into and out of an in-position, whereby an article may be supported in the fork of the shoe and accessories may be stored in the drawer, further comprising a wall base, the shoe and the drawer being mounted on the wall base, and a bottom base means for carrying the weight of an article supported in the fork of the shoe, the bottom base means having a line of dimples arranged in a groove.

12. A holder to support an article and provide accessory storage capability, comprising a forked shoe and a drawer movably mounted relative to the shoe into and out of an in-position, whereby an article may be supported in the fork of the shoe and accessories may be stored in the drawer, further comprising a resilient bumper lining the fork, the fork being cut back more above the bumper than below, for providing additional relief for accommodating flare in an article held in the holder.

13. A holder to support an article and provide accessory storage capability, comprising a forked shoe and a drawer movably mounted relative to the shoe into and out of an in position, whereby an article may be supported in the fork of the shoe and accessories may be stored in the drawer, further comprising a wall base, a dowel, a gate, and a lock, the shoe being mounted to the wall base, the shoe extending perpendicularly from the wall base and terminating in a fork with two fork legs extending generally perpendicularly to the wall base, the shoe having a dished portion near the wall base, the dished portion lying between the wall base and the fork of the shoe, the dowel being mounted perpendicularly to the wall base beneath the shoe, the drawer being provided with a hole for receiving the dowel, the drawer being covered by the dished portion of the shoe in its in-position, the drawer being slidable on the dowel into and out of its in-position, the gate being mounted pivotably on the shoe for pivoting into and out of position closing the fork, the lock being mounted on the shoe for locking the gate in its position closing the fork, the forking lying clear of the drawer when the drawer is in the in-position, whereby an article hung in the fork may block movement of the drawer from its in-position beneath the dished portion into the region beneath the fork.

14. A holder as claimed in claim 13, further comprising resilient bumpers lining the fork, the gate and the portion of the drawer facing the fork in the in-position of the drawer.

15. A mounting system useful for attaching an object to a surface, the object having a front side and a wall side, the wall side being intended to lie against said surface when the object is attached to said surface, the mounting system comprising a pocket on the wall side of the object, the pocket being inaccessible from the front side of the object, the pocket having an opening for receiving a fastener head, the pocket additionally having a slot of smaller lateral size than the opening, the slot extending from the opening for receiving a shank bearing the head, and a hole through the object for receiving a fastener, whereby a first fastener, having a head smaller than the opening but larger than the slot and a shank which fits into said slot, may be driven incompletely into the surface, such that the head remains spaced from the surface, the head inserted through the opening of the pocket and the shank moved into the slot, and a second fastener may then be driven through the hole into the surface, to mount the object to the surface.

16. A mounting system useful for attaching an object to a surface, comprising a pocket on the object, the pocket having an opening for receiving a fastener head, the pocket additionally having a slot of smaller lateral size than the opening, the slot extending from the opening for receiving a shank bearing the head, and a hole through the object for receiving a fastener, whereby a first fastener, having a head smaller than the opening but larger than the slot and a shank which fits into said slot, may be driven incompletely into the surface, such that the head remains spaced from the surface the head inserted through the opening of the pocket and the shank moved into the slot, and a second fastener may then be driven through the hole into the surface, to mount the object to the surface, the object having a drawer means for selectively blocking access to a fastener head in the hole.

17. A holder to support a guitar, comprising a forked shoe and a gate, the gate fitting across the fork in a position closing the fork, the closed fork enclosing a space dimensioned to accomodate the neck of a guitar but block passage of the head or body of a guitar, combined with a guitar held by its neck in said space.

18. A method of using a holder, the holder comprising a forked shoe and a gate, the gate fitting across the fork in a position closing the fork, the closed fork enclosing a space dimensioned to accomodate the neck of a guitar but block passage of the head or body of a guitar, said method comprising the steps of opening the gate, placing a guitar in the holder such that the neck of the guitar is in the fork, and closing the gate.

* * * * *